US007320361B2

(12) United States Patent
Arai et al.

(10) Patent No.: US 7,320,361 B2
(45) Date of Patent: Jan. 22, 2008

(54) HEAT EXCHANGER

(75) Inventors: Hidemoto Arai, Tokyo (JP); Hisao Yokoya, Tokyo (JP); Kenzou Takahashi, Tokyo (JP); Youichi Sugiyama, Tokyo (JP); Masaru Takada, Tokyo (JP); Masataka Yoshino, Tokyo (JP)

(73) Assignee: Mitsubishi Denki Kabushiki Kaisha, Chiyoda-Ku, Tokyo (JP)

( * ) Notice: Subject to any disclaimer, the term of this patent is extended or adjusted under 35 U.S.C. 154(b) by 168 days.

(21) Appl. No.: 11/260,137

(22) Filed: Oct. 28, 2005

(65) Prior Publication Data

US 2007/0095513 A1 May 3, 2007

(51) Int. Cl.
*F28F 3/02* (2006.01)

(52) U.S. Cl. ..... 165/166; 165/59; 165/170

(58) Field of Classification Search ..... 165/166, 165/167, 170, 59

See application file for complete search history.

(56) References Cited

U.S. PATENT DOCUMENTS

| | | | | | |
|---|---|---|---|---|---|
| 4,449,992 | A * | 5/1984 | Yamada et al. | ..... | 96/7 |
| 6,143,390 | A * | 11/2000 | Takamiya et al. | ..... | 428/90 |
| 6,145,588 | A * | 11/2000 | Martin et al. | ..... | 165/166 |
| 6,178,966 | B1 * | 1/2001 | Breshears | ..... | 165/54 |
| 6,536,514 | B1 * | 3/2003 | Sugiyama et al. | ..... | 165/166 |
| 2003/0094269 | A1 * | 5/2003 | Arai et al. | ..... | 165/166 |
| 2005/0082045 | A1 * | 4/2005 | Takada et al. | ..... | 165/166 |

FOREIGN PATENT DOCUMENTS

| | | | | |
|---|---|---|---|---|
| JP | 56-93694 | | 7/1981 | |
| JP | 57-207795 | * | 12/1982 | ..... 165/166 |
| JP | 2002-310589 | | 10/2002 | |
| JP | 2004-504928 | | 2/2004 | |
| JP | 2004-535270 | | 11/2004 | |

* cited by examiner

*Primary Examiner*—Teresa J. Walberg
(74) *Attorney, Agent, or Firm*—Buchanan Ingersoll & Rooney PC

(57) ABSTRACT

A known heat exchanger has a lower rate of blocking the movement of moisture through the joint as compared to a joint bonded with a moisture impermeable adhesive because the corrugated and flat substrates are bonded with thermoplastic fibers by performing heating and pressurizing treatments, but has insufficient moisture permeability because both the flat substrate, which is a partition, and the corrugated substrate, which is a space retaining plate, have a poor moisture permeability.

In a heat exchanger in which two types of air flows are directed across a moisture permeable partition plate spaced apart from an adjacent partition plate by a space retaining plate, and perform heat exchange between them through the partition plate, a joint is formed by bonding the partition plate and the space retaining plate using fluoro-resin or hydrocarbon resin containing a hydrophilic group to provide an excellent moisture absorption and diffusion property.

8 Claims, 5 Drawing Sheets

HEAT EXCHANGER

BACKGROUND OF THE INVENTION

1. Field of the Invention

The present invention relates to a total heat exchanger which exchanges sensible heat and latent heat, and, more particularly, to improvement in a latent heat exchanging efficiency.

2. Description of the Related Art

A known total heat exchanger is described below.

This heat exchanger, which is of a honeycomb structure, is formed by stacking a corrugated substrate, which serves as a space retaining plate, and a flat substrate, which serves as a partition plate. The corrugated and flat substrates are constructed of an artificial paper including cellulose fibers and thermoplastic fibers, and are bonded with the thermoplastic fibers by performing heating and pressurizing treatments, which also provides rigidity (see, for example, Japanese Unexamined Utility Model Registration Application Publication No. 56-93694 (pages 1 to 4, FIG. 1)). Also, there is a document which describes other related art (see, for example, Japanese Unexamined Patent Application Publication No. 2002-310589 (pages 3 to 5, FIGS. 1 to 4)).

A known heat exchanger has, during the exchange of latent heat, a lower rate of blocking the movement of moisture through a joint,. that is, has less of a reduction in an effective moisture permeable area as compared to a joint bonded with a moisture impermeable adhesive because the corrugated and flat substrates are bonded with the thermoplastic fibers by performing heating and pressurizing treatments. However, the known heat exchanger has an insufficient moisture permeability because both the flat substrate, which serves as a partition, and the corrugated substrate, which serves as a space retaining plate, themselves have a poor moisture permeability.

Referring now to the air conditions in summer and winter for the total heat exchanger (cited from JIS B 8628 air conditions for a total heat exchanger), it is shown that, in summer, an outdoor air temperature and a relative humidity are 35°° C. and 64.4% RH respectively, and a room temperature and a relative humidity are 27° C. and 52.4% RH respectively and, in winter, an outdoor air temperature and a relative humidity are 5° C. and 57.8% RH respectively, and a room temperature and a relative humidity are 20° C. and 51.1% RH respectively. That is to say, under the summer and winter air conditions, the energy proportion of humidity (latent heat) to a total heat is about 50%. Particularly, the energy proportion of latent heat of a room in summer accounts for two-thirds. Therefore, a latent heat exchanging efficiency is important. Furthermore when the humidity becomes higher in summer, the proportion of the latent heat becomes larger, and thus, the latent heat exchanging efficiency is of greater importance.

Recently, there has also been a need for further improvement in heat exchanging efficiency of the total heat exchanger. For further improvement in heat exchanging efficiency, improvement in the latent heat exchanging efficiency is particularly important as described above. However, the known heat exchanger still has the above problems.

SUMMARY OF THE INVENTION

The present invention was contemplated taking into consideration the problems described above. It is an object of the present invention to achieve further improvement in the latent heat exchanging efficiency of the heat exchanger to provide a further improvement in heat exchanging efficiency. The heat exchanger according to the present invention, in which two types of air flows are directed across moisture permeable partition plates which are spaced apart by space retaining plates, where heat exchange is performed between the air flows through the partition plate, has joints formed by bonding the partition plate and the space retaining plate with a fluoro resin or a hydrocarbon resin having an excellent moisture absorption and diffusion property that is provided by a hydrophilic group contained therein.

DESCRIPTION OF THE PREFERRED EMBODIMENTS

Embodiment 1

Figure 1:
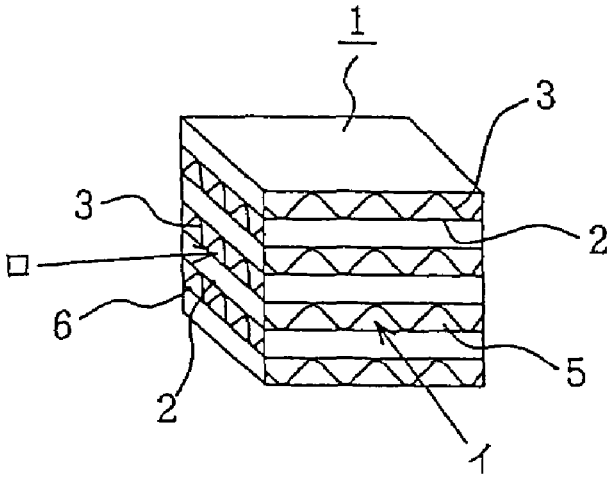
FIG. 1 is a perspective view showing the heat exchanger described in Embodiment 1 according to the present invention.
Figure 2:
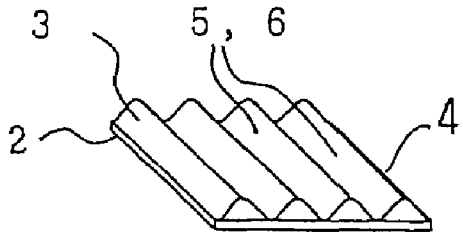
FIG. 2 is a perspective view of the unit constructional element of the heat exchanger shown in FIG. 1.
Figure 3:
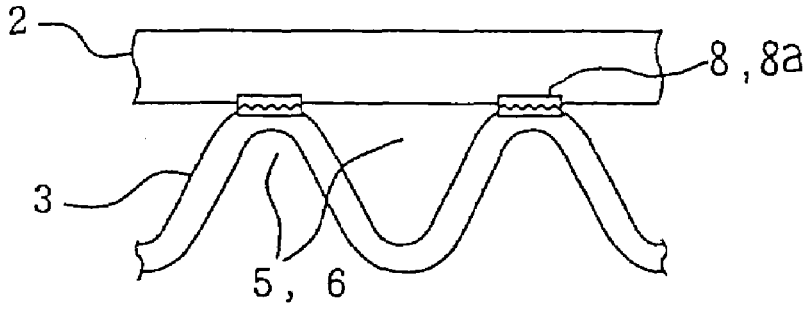
FIG. 3 is an enlarged cross-sectional view of the unit constructional element shown in FIG. 2.

FIG. 1 is a perspective view of the heat exchanger according to the present embodiment; FIG. 2 is a perspective view of the unit constructional element of the heat exchanger of FIG. 1; and FIG. 3 is an enlarged cross-sectional view of the unit constructional element of FIG. 2.

In these drawings, a heat exchanger 1 is of a hexahedron structure which is formed by stacking, in multiple layers, in such a manner that the opening directions (air flow direction) of passageways having a wave shape in the cross section thereof intersect with each other every other layer at an angle of substantially 90 degrees, a plurality of the unit constructional elements (shown in FIG. 2) which are constructed by bonding a space retaining plate 3 having a wave shape in cross section such as a saw tooth shape, a sine wave shape or the like and a projection shape thereof which matches to the projection shape of a partition plate 2 to one side of the partition plate 2 which has a heat transfer property, a moisture permeability property and air shielding property and which is of a thin rectangular projection shape taken in the direction perpendicular to the air flow direction.

The partition plate 2 and the space retaining plate 3 are porous members, and are preferably formed by mixing, for example, resin fibers with cellulose fibers and by mixing a binder in the resins. Alternatively, nonwoven fabrics of polyolefin, including polyethylene, polypropylene, polyethylene terephthalate and the like, and of polyester, metallic fibers, or glass fibers may be used to construct the partition plate 2 and the space retaining plate 3.

Also, the partition plate 2 may be coated with a moisture permeable film layer having an air shielding property on the surface thereof in order to have an air shielding property.

The partition plate 2 and the space retaining plate 3 are joined by bonding the top portion of the wave shape of the space retaining plate 3 to the partition plate 2 with an adhesive 8 as illustrated by the unit constructional element shown in FIG. 3.

The material of the adhesive 8 is composed of resins containing a hydrophilic group which provide an excellent moisture absorption and diffusion property to an adhesive layer 8*a* which serves as a joint layer 8*a* after joining and hardening, for example, perfluoro-sulfonic acid resin (a perfluoro-sulfonic acid ion exchange resin, i.e., fluoro ion exchange resin having a sulfonic acid group serving as a hydrophilic group) which is used for an electrolyte membrane of a proton-exchange electrolyte membrane fuel cell (PEFC).

The perfluoro-sulfonic acid resin has an excellent moisture absorption and diffusion property, i.e., excellent moisture permeability, and durability, and, in addition, an antimicrobial property due to the acid.

In addition to the perfluoro-sulfonic acid resin, a macromolecular copolymer which is partially sulfonized, i.e., a hydrocarbon resin having hydrophilic groups (a hydrocarbon ion exchange resin), may be used as a resin having an excellent moisture absorption and diffusion property. For example, a copolymer of an allyl-vinyl monomer and an olefin monomer which has an average molecular weight of about 20000 and in which an aromatic hydrocarbon bonded with an allyl-vinyl monomer is partially sulfonized is available. Now as an allyl-vinyl monomer, which accounts for 20 to 80 wt % of the total weight, styrene, vinyl-toluene, and a-methyl toluene will be discussed, the styrene there among being most suitable. Preferably, a styrene sulfonic acid accounts for 30 to 50 mol % of the aromatic hydrocarbon which bonds with the allyl-vinyl monomer. Ethylene is most suitable for the olefin monomer. That is, styrene ethylene copolymer resin (ion exchange resin), which has a molecular weight of about 20000 and is partially sulfonized, is recommended.

The hydrocarbon resin (hydrocarbon ion exchange resin) which is sulfonized to have a hydrophilic group has a high level of the moisture absorption and diffusion property, i.e., a high level of the moisture permeability, is relatively less expensive, and also has an antimicrobial property.

For using these resins as the adhesive 8 they are softened by heat, emulsified, or dispersed in solvents including alcohol or acetone before use.

The heat exchanger 1 which is formed in a manner described above is used in an air conditioning machine and performs total heat exchange without mixing between adjacent air flows across the partition plate 2 because, as shown in FIG. 1, the primary air flow a, for example, a fluid passageway 5 through which an exhaust air passes from a room, and the secondary air flow b, for example, a fluid passageway 6 through which a supply air passes from outdoors, intersect every other layer.

That is, the heat exchanger 1 performs total heat exchange between the exhaust air which is discharged from a room and the supply air which is introduced into a room during the introduction of fresh air from the outdoors into the room so as to make the temperature and humidity properties of the supply air close to those of the room air.

Figure 5:
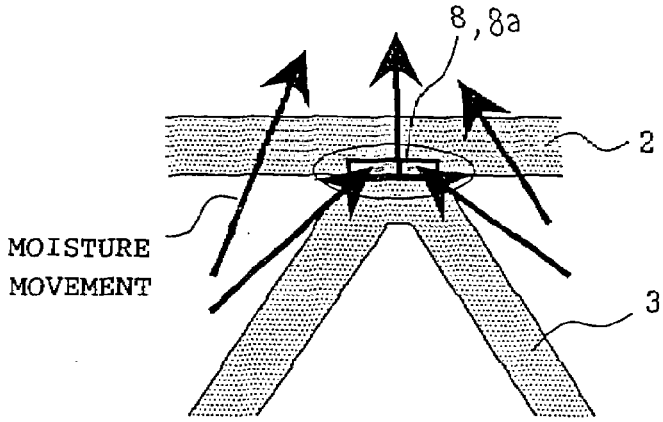
FIG. 5 is an enlarged cross-sectional view of the main portion showing the heat exchanger structure and moisture movement of the heat exchanger described in Embodiment 1 according to the present invention.

Also, the use of the adhesive 8 described above enables absorption and movement of moisture from the joint 8*a*, i.e., the adhesive layer 8*a* to the partition plate 2 that have been disabled because of the adhesive which has no moisture permeability has been conventionally used, which clogged up pores of the partition plate 2 during corrugating and stacking processes. This results in an increase in the effective moisture permeable area of the partition plate 2 as compared to the joint formed by the adhesive which has no moisture permeability as shown in FIG. 5 which clearly illustrates the movement of moisture by arrows.

An illustrative example of an increase in the effective moisture permeable area is described with reference to FIG. 4.

Figure 4:
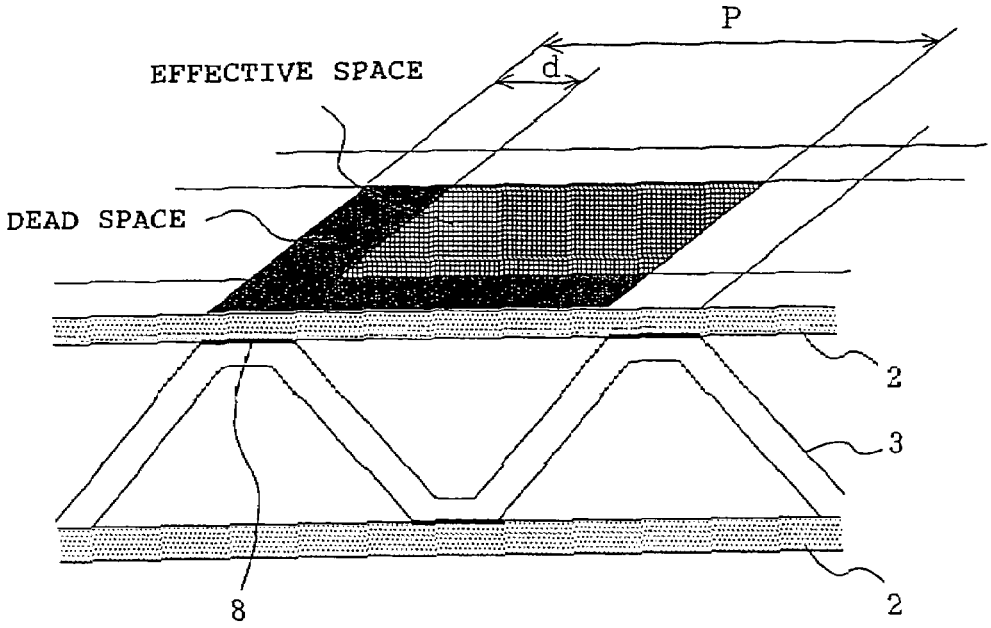
FIG. 4 is an explanatory diagram describing the effective moisture permeable area of the partition plate of the heat exchanger described in Embodiment 1 according to the present invention.

As shown in FIG. 4, on the top and under surfaces of the partition plate 2, the pitches between joints formed between the partition plate 2 and space retaining plate 3 is designated by P on both sides of the joint, and the width of the joint is designated by d, and then it is assumed that P/d is, for example, 4.4. Now the ratio of an area not included in the joint with the space retaining plate 3, i.e., the moisture permeable area of the partition plate 2 which is provided when the joint is formed by the impermeable adhesive, to the total area of the area not included in the joint with the space retaining plate 3 and the area of the joint with the space retaining plate 3 is expressed by the following equation.

$$(P-d)^2/P^2=0.6$$

The use of the adhesive 8 according to the present embodiment makes an entire area including the joint 8*a* moisture-permeable so as to increase the ratio of the effective moisture permeable area to the total area from 0.6 to 1.0.

In addition to the increase in the effective moisture permeable area of the partition plate 2 as described above, the heat exchanger 1 uses a resin having a higher level of the moisture absorption and diffusion property as the adhesive 8 so that a larger quantity of moisture is allowed to be absorbed, diffused and penetrate the partition plate 2 through the joint 8*a* as compared to the joint which is described in the related art because the joint 8*a* can serve as a moisture absorbing and diffusing layer. That is, a larger quantity of moisture can penetrate the partition plate 2. This results in a substantially further increased effective moisture permeable area so as to enable a larger quantity of moisture to be given to the air flows which pass through the longitudinally-adjacent fluid passageways. Therefore, further improvement in the latent heat exchanging efficiency of the heat exchanger 1 can be achieved (refer to FIG. 5).

An oval shown in FIG. 5 clearly shows the location of the joint between the partition plate 2 and the space retaining plate 3. This is true for FIGS. 6 to 10.

In the present embodiment, when the heat exchanger constructional elements 6 cut out are stacked in such a way that the wave divisions of adjoining space retaining member plates 3 extend in parallel, a countercurrent type heat exchanger 1 can be constructed.

Embodiment 2

Figure 6:
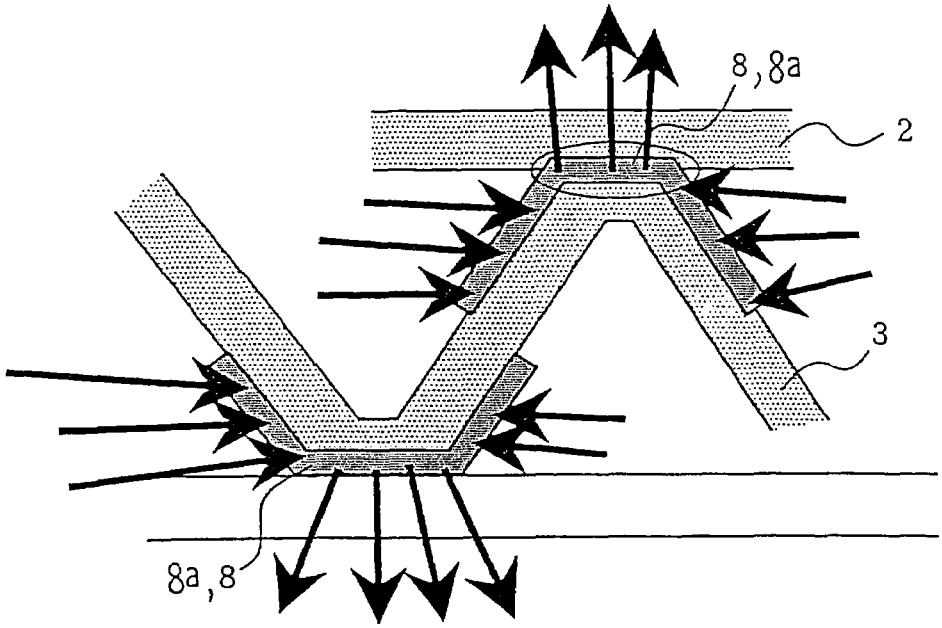
FIG. 6 is an enlarged cross-sectional view of the main portion showing the heat exchanger structure and moisture movement of the heat exchanger described in Embodiment 2 according to the present invention.

FIG. 6 is an enlarged cross sectional view of the main portion showing the structure and moisture movement of the heat exchanger described in the embodiment 2 according to the present invention. The heat exchanger 1 according to the present embodiment has the same features as those of the embodiment 1 except for an improvement in the space retaining plate 3. Therefore, the following description is mainly about differences between them.

The adhesive 8 is used to bond the top of the space retaining plate 3 of the heat exchanger 1 according to the present embodiment to the partition plate 2 in the same way as that of the embodiment 1. During this process, the adhesive 8 is provided to the circumference of the top in addition to the joint 8*a* of the space retaining plate 3. The moisture absorbing and diffusing layer is formed by, for example, applying the adhesive layer 8*a*, i.e., the adhesive 8, continuously around the joint 8*a* on the surface of the space retaining plate 3 in a proportion of 30 to 50% of the surface area of the space retaining plate 3. That is to say, according to the present embodiment, as shown in FIG. 6, the adhesive 8 is attached to the circumference (accounts for 30 to 50% of two sides of the roughly triangular cross section formed by the space retaining plate 3) of the top of the space retaining plate 3 in addition to the attachment to the top thereof only, while, in the related art which uses the impermeable adhesive, adhesive is attached in as small a quantity as possible to the top of the space retaining plate 3 to prevent the effective moisture permeable area from being reduced.

The technique described above allows the moisture absorbing and diffusing layer of the space retaining plate 3 which is formed adjacently to the joint 8*a* with the partition plate 2 to have a higher level of the moisture absorption and diffusion property in addition to the joint 8*a* so that the moisture absorbing area is increased. Thus, the moisture of the air flows which pass through the fluid passageways is absorbed by the moisture absorbing and diffusing layer of the space retaining plate 3, diffused therein, and penetrates the partition plate 2 through the joint 8*a* between the partition plate 2 and the space retaining plate 3 to moisten the adjacent dry air flows. In particular, the moisture absorbing and diffusing layer has a higher level of the moisture absorption and diffusion property to absorb and diffuse a larger quantity of the moisture.

Thus, the moisture permeability of the partition plate 2 is improved, that is, the substantially effective moisture permeable area of the partition plate 2 is increased so that the moisture exchanging efficiency (latent heat exchanging efficiency) is improved. This leads to a further improvement in the heat exchanging efficiency.

In the related art, the cross-sectional shape of the space retaining plate 3 which is bonded to the partition plate 2 has been formed in triangles as acute as possible to minimize the width (corresponds to the area of the joint) of the joint 8*a*. However, the high speed manufacturing by a corrugating machine and the like causes ridge cracks, which means a break with cracks formed in the space retaining plate 3, to occur, thus, the manufacturing speed must be reduced. As a result, the workability has been degraded.

The present embodiment permits workers not to pay attention to a quantity of the attached adhesive 8 and the resulting width because the joint 8*a* has a high level of the moisture absorption and diffusion property. Therefore, as the space retaining plate 3, a corrugated plate which has stages of a rounded shape called a UV or U stage which provides a high workability is permitted to be manufactured and used. This results in an improvement in the manufacturing speed at which the unit constructional elements 4 are manufactured by the corrugating machine, and leads to an improvement in workability.

The corrugated stage with a rounded stage shape called the UV or U stage makes it easier, due to the rounded shape thereof, to attach a large quantity of the adhesive 8 as compared to the conventional stage shape. This corrugated stage is advantageous because it is preferred to attach the adhesive 8 in a quantity as large as possible to the space retaining plate 3.

A stacking process was actually carried out by using U-shaped corrugated stages. As a result, the adhesive could be attached to about 30 to 50% of the side area of the space retaining plate 3. This means that about three times of the related art minimum necessary quantity of the adhesive 8 (bonding agent 8) can be achieved.

That is, it has been assumed that the impermeable adhesive 8 conventionally provides the effective moisture permeable area which accounts for about 60% of the side area of the space retaining plate. The present embodiment has successfully achieved the moisture exchanging efficiency which is equivalent to that obtained when the effective moisture permeable area corresponding to substantially about 110% of the side area of the space retaining plate is achieved. That is, the substantial expansion of the effective moisture permeable area has been achieved.

Embodiment 3

Figure 7:
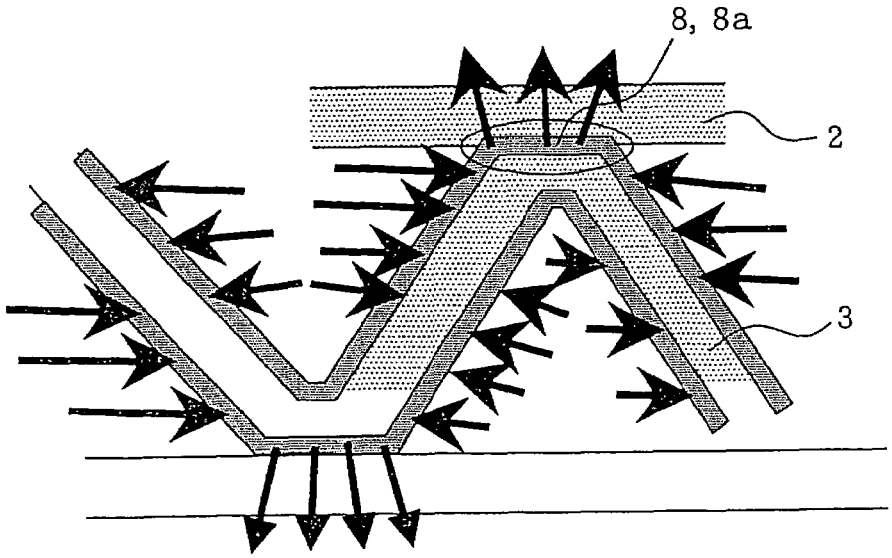
FIG. 7 is an enlarged cross-sectional view of the main portion showing the heat exchanger structure and moisture movement of the heat exchanger described in Embodiment 3 according to the present invention.
Figure 8:
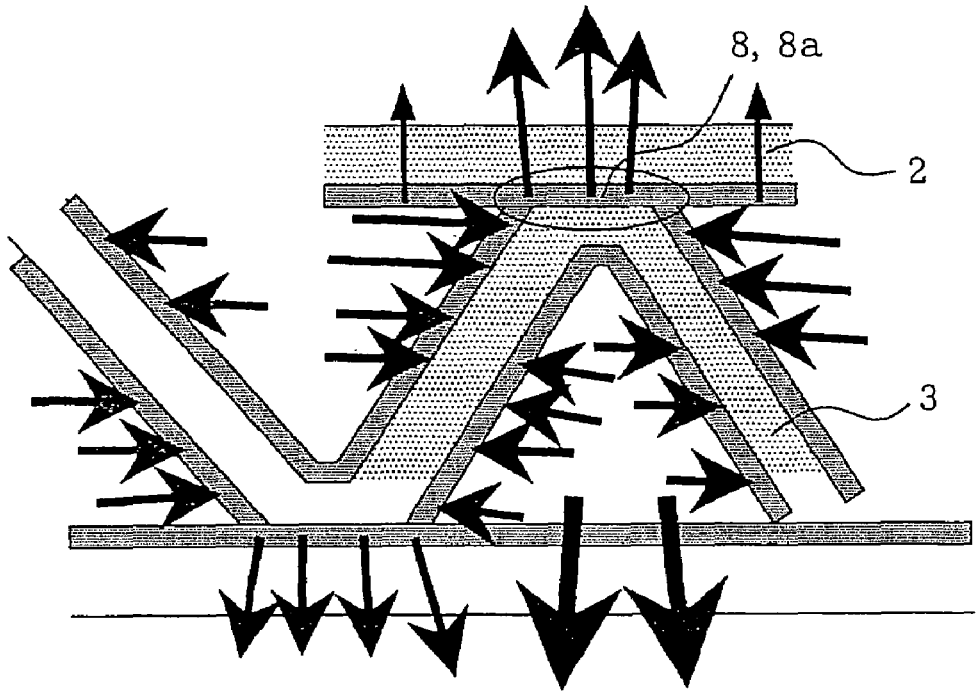
FIG. 8 is an enlarged cross-sectional view of the main portion showing the heat exchanger structure and moisture movement of another heat exchanger described in Embodiment 3 according to the present invention.
Figure 9:
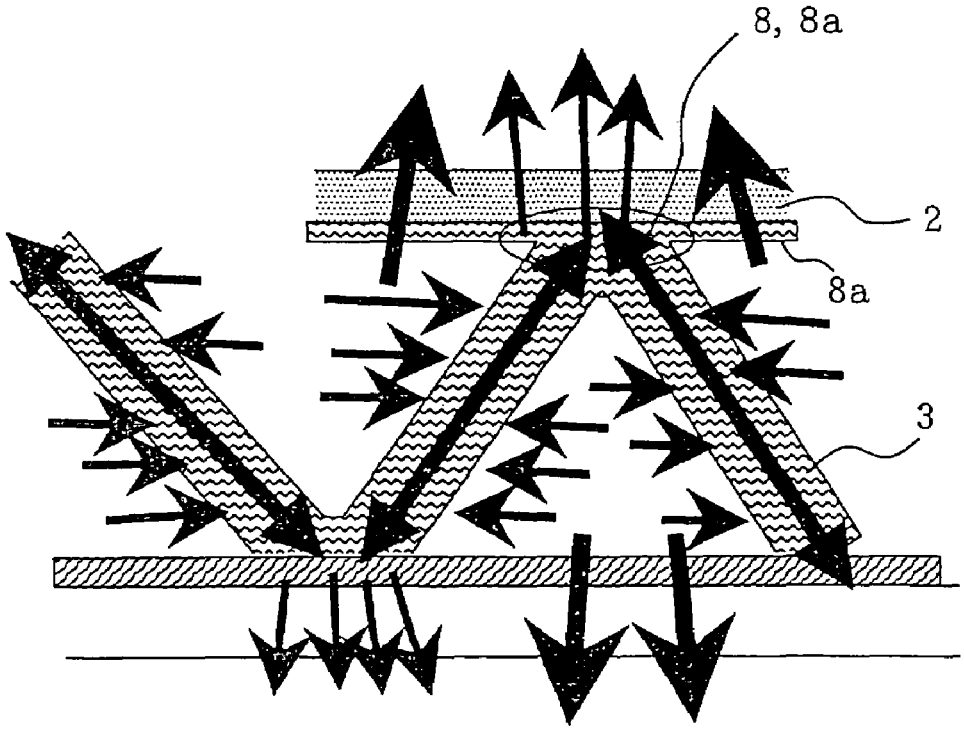
FIG. 9 is an enlarged cross-sectional view of the main portion showing the heat exchanger structure and moisture movement of still another heat exchanger described in Embodiment 3 according to the present invention.
Figure 10:
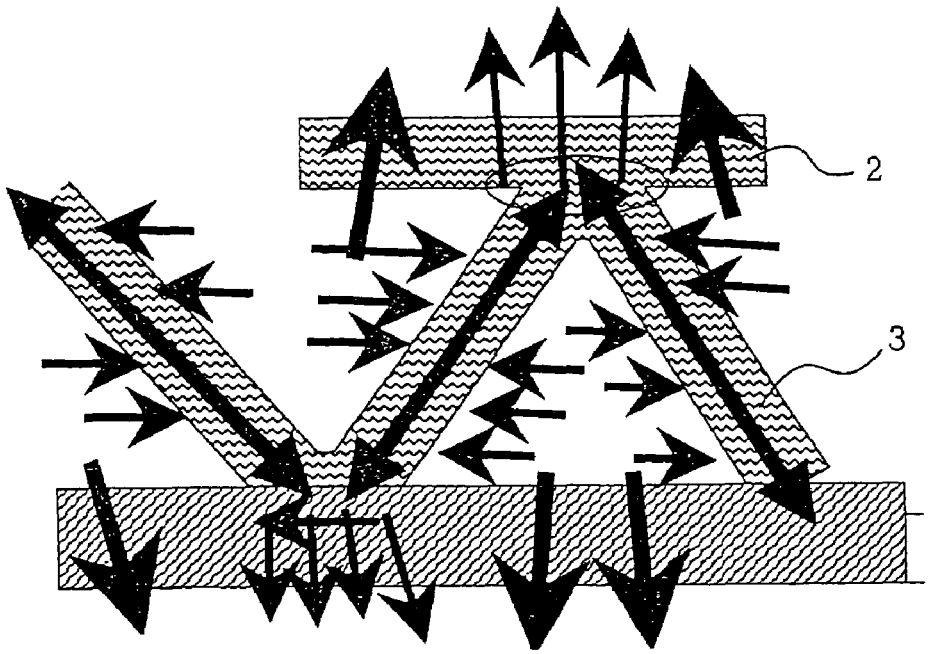
FIG. 10 is an enlarged cross-sectional view of the main portion showing the heat exchanger structure and moisture movement of further still another heat exchanger described in Embodiment 3 according to the present invention.

FIG. 7 is an enlarged cross sectional view of the main portion which shows the structure and moisture movement of the heat exchanger described in the embodiment 3 according to the present invention. FIGS. 8, 9, and 10 are an enlarged cross sectional view of the main portion which shows the heat exchanger structure and moisture movement of separate heat exchangers. The heat exchanger according to the present embodiment is equivalent to those of embodiments 1, and 2 except that the partition plate 2 and space retaining plate 3 have been improved, so the following description is mainly about differences between them. Arrows indicate the movement of the moisture in each figure.

As shown in FIG. 7, the resin having the same ingredients as the adhesive 8 used in embodiment 1 and 2 is applied on the entire surface (on both sides) of the space retaining plate 3 to form, on the entire surface (on both sides) of the space retaining plate 3, the moisture absorbing and diffusing layer having a thickness of about 100 to 150 μm and a high level of the moisture absorption and diffusion property. This moisture absorbing and diffusing layer absorbs the moisture through the entire surface of the space retaining plate 3, and then diffuses it to the continuously formed adhesive layer 8*a* (joint 8*a*). A large quantity of the moisture is thus moved through the partition plate 2 to the upper-adjacent and lower-adjacent layers to provide the air flows with the moisture. Thus, the moisture exchanging efficiency (latent heat exchanging efficiency) can be improved. As compared to the example shown in FIG. 6, the quantity of moisture which penetrates the partition plate 2 is increased by an increase in moisture permeable area, that is, the substantially effective moisture permeable area of the partition plate 2 is increased.

Also, in the heat exchanger 1 according to the present embodiment, improvement in the mechanical strength of fragile materials, including paper possibly used as a porous material for the space retaining plate 3, is achieved by coating and allows them to be used for the space retaining plate 3.

The heat exchanger 1 shown in FIG. 8 has the surface of the partition plate 2 coated with the moisture absorbing and diffusing layer of about 100 to 150 μm thick in addition to the moisture absorbing and diffusing layer formed on the surface of the space retaining plate 3.

The coatings described above increase the substantially effective moisture permeable area so that the moisture absorbing performance of the partition plate 2 is improved due to formation of the moisture absorbing and diffusing layer having a high level of the moisture absorption and diffusion property. This results in an increase in the quantity of the moisture which penetrates the partition plate 2. Thus, the moisture exchanging efficiency (latent heat exchanging efficiency) can be dramatically improved.

The formation of the moisture absorbing and diffusing layer only around the joint 8*a* on the space retaining plate 3, as shown in FIG. 6, offers nearly the same effect as the formation on the entire surface area of the space retaining plate 3 as shown in FIG. 8.

Moreover, the formation of the moisture absorbing and diffusing layer on the surface of the partition plate 2 only can provide an increase in the substantially effective moisture permeable area so that the quantity of the moisture which penetrates the partition plate 2 can be increased instead of the formation of the layer on the surfaces of both partition plate 2 and the space retaining plate 3. This leads to an achievement of the improvement in the moisture exchanging efficiency (latent heat exchanging efficiency).

The heat exchanger 1 shown in FIG. 9 has the moisture absorbing and diffusing layer which is formed from the resin having the same ingredients as the adhesive 8 used in Embodiments 1 and 2 on the surface of the partition plate 2, and the space retaining plate 3 which is formed from the same resin. However, when having an insufficient mechanical strength and dimensional stability that are provided by the resin described above only, the space retaining plate 3 may be strengthened by means of a reinforcing member including a polytetrafluoroethylene (PTFE) core member and by mixing PTFE fibril, or may be formed from a composite of PTFE and perfluorosulfonic acid resin.

This way allows the space retaining plate 3 by itself to serve as a moisture absorbing and moving medium. Therefore, an increase in the substantially effective moisture permeable area of the partition plate depending on the increase in the moisture permeable area makes possible a dramatic improvement in the moisture exchanging efficiency (latent heat exchanging efficiency).

In this way, as shown in FIG. 9, the moisture absorbing and diffusing layer which is formed on the partition plate 2 improves the moisture exchanging efficiency (latent exchanging efficiency). At least, if the joint 8*a* between the partition plate 2 and the space retaining plate 3 covered with the moisture absorbing and diffusing layer is formed from the adhesive 8 used in Embodiment 1, the moisture exchanging efficiency (latent heat exchanging efficiency) is improved because the moisture is absorbed by the space retaining plate 3, diffused therein, and then supplied through the joint 8*a* to the partition plate 2.

Also, as shown in FIG. 10, both the space retaining plate 3 and the partition plate 2 may be formed from the resin having the same ingredients as the adhesive 8 used in Embodiment 1 and 2 and bonded by the joint 8*a*. If it is necessary to improve the mechanical strength, the measures described above can be taken.

This way also makes it possible to dramatically improve the moisture exchanging efficiency (latent heat exchanging efficiency).

The heat exchanger according to the present invention, in which two types of air flows are directed across a moisture permeable partition plate spaced apart from an adjacent partition plate by a space retaining plate, where heat exchange is performed through the partition plate between the two types of the air flows, has a joint which is formed between the partition plate and the space retaining plate by bonding them using fluoro-resins or hydrocarbon resins which contain a hydrophilic group which provides a high level of the moisture absorption and diffusion property so as to achieve an increased substantially effective moisture permeable area, an improvement in the moisture exchanging efficiency (latent heat exchanging efficiency), and a further improvement in the heat exchanging efficiency.

What is claimed is:

1. A heat exchanger in which two types of air flows are directed across a moisture permeable partition plate spaced apart from an adjacent partition plate by a space retaining plate, wherein heat exchange is performed between the two types of air flows through said partition plate, said heat exchanger comprising a joint that is formed by bonding said partition plate and said space retaining plate using fluoro-resin or hydrocarbon resin containing a hydrophilic group and having an excellent moisture absorption and diffusion property.

2. The heat exchanger according to claim 1, wherein said hydrophilic group is a sulfonic acid group, and said fluoro-resin and hydrocarbon resin are a perfluorosulfonic acid resin and a styrene-ethylene copolymer which is partially sulfonized, respectively.

3. The heat exchanger according to claim 1, further comprising a moisture absorbing and diffusing layer that is formed continuously around said joint with said partition plate on the surface of said space retaining plate using said resin.

4. The heat exchanger according to claim 1, further comprising a moisture absorbing and diffusing layer that is formed continuously around said joint with said partition plate on the entire surface of said space retaining plate using said resin.

5. A heat exchanger in which two types of air flows are directed across a moisture permeable partition plate spaced apart from an adjacent partition plate by a space retaining plate, wherein heat exchange is performed between the two types of air flows through said partition plate, said heat exchanger comprising a moisture absorbing and diffusing layer that is formed on the surface of said partition plate and that includes fluoro-resin or hydrocarbon resin containing a hydrophilic group and having an excellent moisture absorption and diffusion property.

6. The heat exchanger according to claim 5, further comprising a moisture absorbing and diffusing layer that is formed on the surface of said space retaining plate and that includes fluoro-resin or hydrocarbon resin having an excellent moisture absorption and diffusion property and provides continuity with the moisture absorbing and diffusing layer on said partition plate.

7. The heat exchanger in which two types of air flows are directed across a moisture permeable partition plate which is spaced apart from an adjacent partition plate by a space retaining plate and, wherein the heat exchange is performed between the two types of air flows through said partition plate, wherein at least one of said partition plate and said space retaining plate is formed from a fluoro-resin or hydrocarbon resin having an excellent moisture absorption and diffusion property, wherein, if only said space retaining plate is formed from said resin, a joint with said partition plate is formed from said resin, and alternatively if both said partition and said space retaining plate are formed from said resin, both plates have a joint which is formed from said resin therebetween.

8. The heat exchanger according to claim 7, wherein, except for said joint, said resin is mixed with a reinforcing agent to maintain the mechanical strength thereof.

* * * * *